US005358107A

United States Patent [19]

Laske

[11] Patent Number: 5,358,107

[45] Date of Patent: Oct. 25, 1994

[54] PACKAGING COVER FOR A CLEANING APPARATUS HAVING BRISTLES

[75] Inventor: Les A. Laske, Grayslake, Ill.

[73] Assignee: Vonco Products, Inc., Lake Villa, Ill.

[21] Appl. No.: 36,497

[22] Filed: Mar. 24, 1993

[51] Int. Cl.[5] ..... B65D 83/10; A46B 17/04

[52] U.S. Cl. ..... 206/361; 206/362.2; 206/362.3; 206/362.4; 15/247

[58] Field of Search ..... 206/361, 362.2, 362.3, 206/362.4; 15/247

[56] References Cited

U.S. PATENT DOCUMENTS

| | | | |
|---|---|---|---|
| 131,855 | 10/1872 | Crandal . | |
| 234,289 | 11/1880 | Kent . | |
| 835,725 | 11/1906 | Bollman . | |
| 960,158 | 5/1910 | Cummings et al. | 15/247 |
| 964,402 | 7/1910 | Davis | 15/247 |
| 1,138,305 | 5/1915 | Miller . | |
| 1,360,926 | 11/1920 | Glenn | 15/247 |
| 1,804,504 | 5/1931 | Henderson | 15/247 |
| 1,929,082 | 10/1933 | Simon | 15/247 |
| 2,269,424 | 1/1942 | Bernstein | 15/247 |
| 2,485,068 | 10/1949 | Santana . | |
| 2,709,824 | 6/1955 | Hall | 15/247 |
| 2,979,189 | 4/1961 | Allen | 206/362.4 |
| 3,055,492 | 9/1962 | Franklin et al. | 206/361 |
| 3,136,409 | 6/1964 | Schumann . | |
| 3,167,178 | 10/1965 | Saunders . | |
| 3,462,790 | 8/1969 | Lingle | 15/247 |
| 3,860,115 | 1/1975 | Laske | 206/361 |

*Primary Examiner*—Jimmy G. Foster
*Assistant Examiner*—Marie Denise Patterson
*Attorney, Agent, or Firm*—Speckman, Pauley & Fejer

[57] ABSTRACT

A packaging cover for bristles of a cleaning apparatus having a base with a neck portion, wherein the bristles are attached to the base. The packaging cover has two webs of flexible sheet material. The packaging cover has a base end and an opposite top end. Both webs are joined at the top end and/or the base end. At least one of the webs has at least one opening near the base end wherein each opening is large enough to accommodate the neck portion of the cleaning apparatus. Both webs have opposing sides which extend between the base end and top end. Both webs are separated from each other along at least a portion of each of the opposing sides.

10 Claims, 2 Drawing Sheets

PACKAGING COVER FOR A CLEANING APPARATUS HAVING BRISTLES

BACKGROUND OF THE INVENTION

1. Field of the Invention

This invention relates to a packaging cover which is wrapped around bristles and a base structure, of a cleaning apparatus, such as a broom, a brush, a mop or the like, to which the bristles are attached. The packaging cover is preferably constructed of plastic or paper sheet material on which an advertising or instructional message can be displayed.

2. Description of Prior Art

Conventional packaging covers for brooms, brushes, mops and the like typically have sealed opposing sides, an open top end and an open bottom end. With such conventional packaging covers, because the bristles normally diverge toward the free ends of the bunched bristles, the packaging cover is installed by inserting a handle of the utensil through the open top end and then through the open bottom end, until the top end is positioned at a desired location with respect to the bristles. With sealed or closed sides, a separated or open top end, and a separated or open base end, such conventional packaging covers are easily and undesirably displaced from the desired position.

To overcome the stability problems associated with conventional packaging covers discussed above, a packaging cover with sealed corner areas of the top end of the package was developed. U.S. Pat. No. 3,860,115 teaches such packaging cover. The opposing sides of such packaging cover are closed. Thus, such packaging cover is installed in a manner similar to the installation of other known packaging covers, as discussed above.

U.S. Pat. No. 3,167,178 discloses a paint brush wrapper. An envelope of substantially rectangular configuration has four edges forming two opposing sides, a top and a bottom. Both sheets of material of the envelope are sealed at the top and an adjacent side. At the side which is opposite the sealed side, both sheets of material are unsealed. Along a second edge of the envelope, both sheets are unsealed. A handle of a paint brush is first inserted into the side opening and then through the bottom opening, and the paint brush handle is moved further through the bottom opening until the bristles are enclosed between both sheets of material. A flap of one sheet of the material is used to close off the open side, once the paint brush is inserted within the envelope.

It is apparent that there is a need for a packaging cover which is relatively stable once installed, and which can be conveniently installed on cleaning apparatuses having various bundled shapes of the bristles. With the improved arrangement of bristles on modern cleaning apparatuses, it is necessary to have a packaging cover that can accommodate the various shapes and arrangements of bundled bristles.

SUMMARY OF THE INVENTION

It is one object of this invention to provide a packaging cover that can be easily installed on a cleaning utensil having one or more bundles of bristles, regardless of whether a handle is attached to a base member of the cleaning apparatus.

It is another object of this invention to provide a packaging cover that requires reduced polymeric material for its intended purpose, of displaying advertising and/or instructional print, and is thus an environmentally-conscious product.

It is another object of this invention to provide a packaging cover that can be quickly, easily and economically mass produced.

It is still another object of this invention to provide a packaging cover that is stable and maintains its desired position when installed around the bristles of a cleaning apparatus.

The above and other objects of this invention are accomplished with a packaging cover that has two webs of flexible sheet material. When mounted, the packaging cover preferably has a base end which is positioned near the base of the cleaning apparatus, and a top end which is positioned opposite of the base end. The webs are preferably joined at the top end and/or the base end, such as by heat sealing both webs together. At least one of the webs has one or more openings near the base end. Each opening is preferably large enough to accommodate a neck portion of the base of the cleaning apparatus. Such neck portion is either an integral part of a handle, or is used to attach a handle or the like to the base of the cleaning apparatus.

Each web of the sheet material has two opposing sides, each of which extend between the base end and the top end. The webs are preferably separated from each other along at least a portion of at least one side.

In one preferred embodiment according to this invention, both sides are separated entirely between the top end and the base end. In another preferred embodiment according to this invention, both webs are joined together along at least a portion of the base end.

In another preferred embodiment according to this invention, in a mounted position of the packaging cover, a single piece of the sheet material is folded at the top end and thus forms the two webs. In still another preferred embodiment according to this invention, each web has at least one opening, preferably a slit or a circular hole, and both sides of each web are correspondingly joined, such as with a heat seal, to corresponding sides of the other web, along only a portion of each side of each web from the top end.

BRIEF DESCRIPTION OF DRAWINGS

FIG. 8b shows a side view of the packaging cover, as shown in FIG. 8a; and

DESCRIPTION OF PREFERRED EMBODIMENTS

By having a packaging cover with two webs which are not heat sealed or otherwise joined together along at least a portion of both opposing sides of the packaging cover, several significant advantages are derived. For example, advertising and instructional print can be displayed while using less material for such intended purpose. With the packaging cover according to this invention, less material is used because bristles can extend beyond both sides of the packaging cover, since both sides are open or unsealed. Less plastic material has apparent environmental advantages. Less material reduces the overall cost of the packaging cover. The open sides provide better ventilation to the bundles of bristles and thus reduces mold or mildew build-up between the bristles. Also, by using less material and by having both opposing sides of the packaging cover at least partially open, the packaging cover according to this invention is easy to install. By having both sides of the packaging cover at least partially open, the bristles can be inserted between the webs from either side of the packaging cover.

Figure 1:
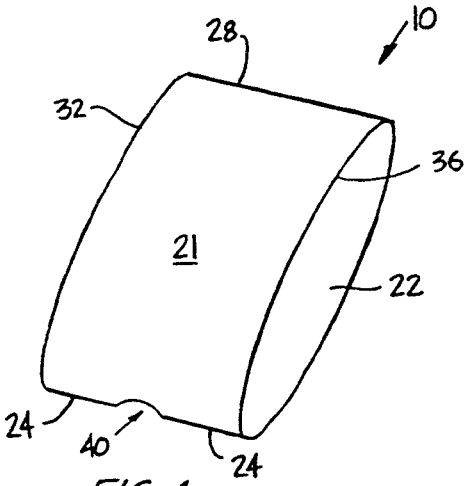
FIG. 1 is a perspective view of a packaging cover, according to one preferred embodiment of this invention.
Figure 2A:
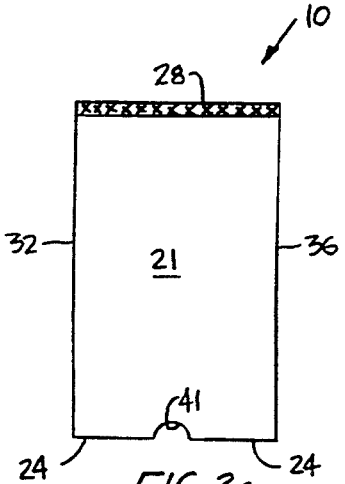
FIG. 2*a* is a front view of the packaging cover, as shown in FIG. 1.
Figure 2B:
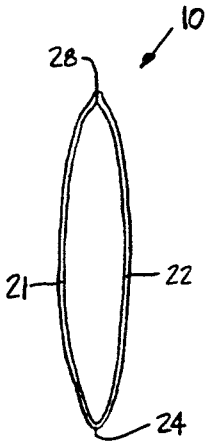
FIG. 2*b* is a side view of the packaging cover, as shown in FIGS. 1 and 2*a;*
Figure 3:
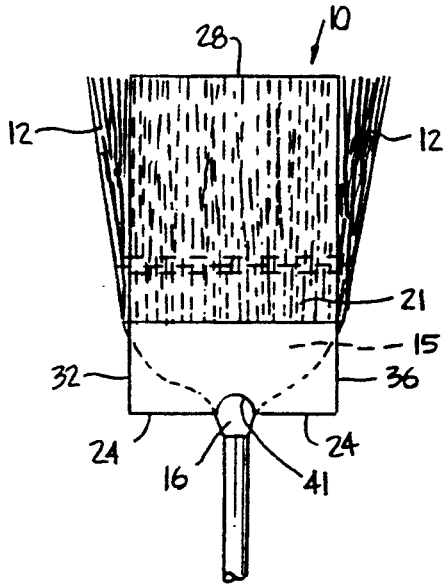
FIG. 3 is a front view showing the packaging cover of FIGS. 1–2*b*, installed on a conventional broom.

FIGS. 1–2b show different views of packaging cover 10 according to one preferred embodiment of this invention. FIG. 3 shows such preferred packaging cover 10 installed on a conventional broom. It is apparent that packaging cover 10 of this invention can be used to wrap or cover bristles of any other suitable cleaning apparatus, such as a brush, a mop, or the like. As shown in FIG. 3, bristles 12 are attached to base 15 and packaging cover 10 covers only a portion of the bundle of bristles 12.

Referring to FIGS. 1–2b, packaging cover 10 preferably comprises web 21 and web 22 of flexible sheet material. It is apparent that such flexible sheet material can be a suitable polymeric material, such as a plastic sheet, a paper sheet, a foil sheet, or the like.

As clearly shown in FIG. 2a, packaging cover 10 has base end 24 and top end 28 which is opposite base end 24. Webs 21 and 22 are joined together at top end 28, preferably but not necessarily along the entire edge at top end 28. Webs 21 and 22 can be joined together by forming an integral piece of sheet material, by using a heat seal, an adhesive, or by any other suitable method known to those skilled in the art. It is apparent that webs 21 and 22 can be joined by such suitable methods at top end 28 and/or base end 24.

Figure 4A:
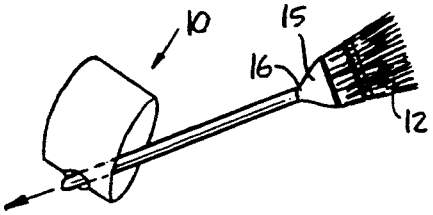
FIGS. 4*a* and 4*b* are diagrammatic views showing two steps of an installation procedure of the packaging cover as shown in FIGS. 1–3.

At least one of webs 21 and 22 has at least one opening 40 near base end 24, wherein each opening 40 is large enough to accommodate neck portion 16 of base 15. As used throughout this specification and in the claims, the phrase "large enough to accommodate" is intended to relate to opening 40 being of sufficient size so that web 21 or 22 can be secured with respect to base 15 by positioning neck portion 16 within opening 20, for example as shown in FIG. 3. Also as used throughout the specification and in the claims, the phrase "neck portion" is intended to relate to either an integral part of base 15 or a handle which is attached to base 15, as shown in FIG. 4a.

Each web 21 and 22 has side 32 and side 36, wherein side 36 is opposite side 32. Side 32 and side 36 each extend between base end 24 and top end 28. It is a very important aspect of one preferred embodiment of this invention for webs 21 and 22 to be separated from each other, along at least a portion of each of side 32 and side 36.

In the preferred embodiment of packaging cover 10, as shown in FIGS. 1–3, webs 21 and 22 are joined together along at least a portion of base end 24. Webs 21 and 22 are not joined together at the portion of base end 24 that defines opening 40. As shown in FIGS. 1–2b, webs 21 and 22 are separated entirely along each of side 32 and side 36. Depending upon the particular configuration of bristles 12, it may not be necessary to separate webs 21 and 22 entirely along one of either side 32 or side 36. Such separation is preferred since having both sides 32 and 36 open will improve the ventilation of bristles 12 and will also accommodate easier assembly and installation of packaging cover 10 on the cleaning apparatus, since bristles 12 can be inserted between webs 21 and 22 from either side 32 or side 36.

As shown in FIGS. 1, 2a and 3, opening 40 is shaped as circular hole 41. It is apparent that other suitable shapes of opening 40 can be used to accomplish the same result of accommodating neck portion 16 or a handle which is attached to neck portion 16. As shown in FIG. 2a, circular hole 41 is approximately centered along base end 24.

As represented in FIG. 2a by a line of crossed-marks, webs 21 and 22 are preferably heat sealed along top end 28. Webs 21 and 22 can also be heat sealed or otherwise joined together along base end 24, in lieu of or in addition to top end 28. It is apparent that any such heat seal can be an edge heat seal, a margin heat seal or any other suitable type of heat seal. It is also apparent that such webs can be joined by either forming a continuous sheet of flexible material, thereby forming somewhat of a tubular shape when both sides 32 end 36 are open, or by any other suitable adhesive or method known to those skilled in the art.

Figure 4B:
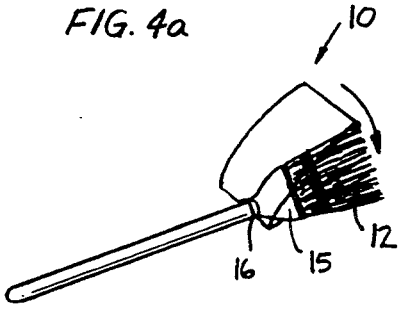

FIGS. 4a and 4b are diagrammatic views which show how packaging cover 10, according to the preferred embodiment as shown in FIGS. 1–3, is installed on a conventional broom. The broom handle is inserted between webs 21 and 22 and within opening 40, in the direction of the arrow, as shown in FIG. 4a. After packaging cover 10 is slid or otherwise positioned toward bristles 12, along the broom stick handle, base 15 or neck portion 16 acts as a stop to prevent packaging cover 10 from moving further, thus preventing undesirable slipping movement of packaging cover 10 with respect to bristles 12, once set into position. As shown in FIG. 4b, bristles 12 are inserted between webs 21 and 22 by pivoting top end 28 in the direction of the arrow shown in FIG. 4b. Due to packaging cover 10 having side 32 and side 36 open, packaging cover 10 can be inserted from either side 32 or 36.

Figure 5A:
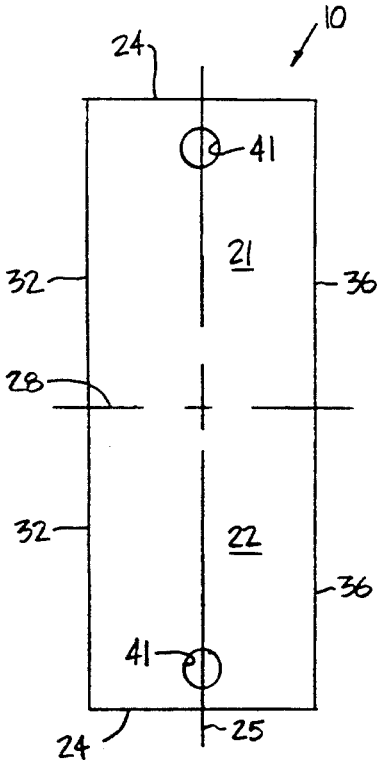
FIG. 5*a* is a front view of a packaging cover, according to another preferred embodiment of this invention.
Figure 5B:
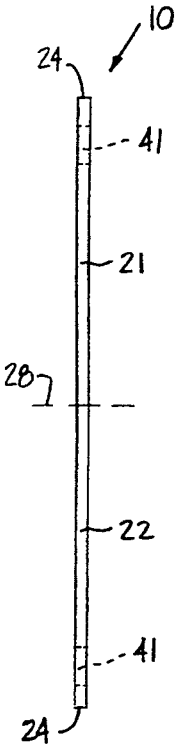
FIG. 5*b* is a side view of the packaging cover, as shown in FIG. 5*a;*
Figure 6:
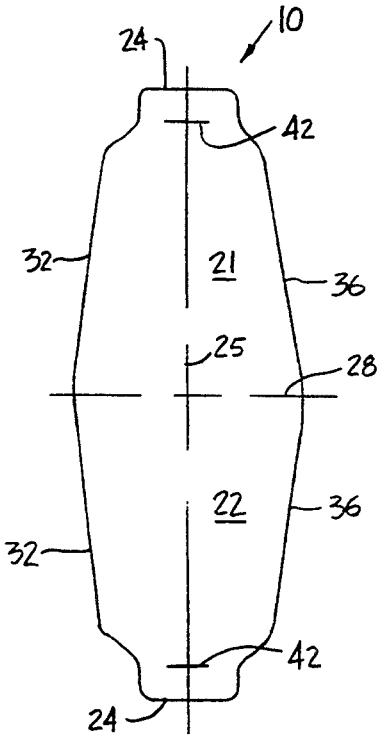
FIG. 6 is a front view of another preferred embodiment of a packaging cover, which is similar to the packaging cover shown in FIG. 5*a* but of a different shape.

Referring to FIGS. 5a–6, another preferred embodiment of packaging cover 10 is shown. FIG. 5a shows an elongated, generally rectangular single piece of sheet material which in a mounted position of packaging cover 10 forms webs 21 and 22. As shown in FIGS. 5*a* and 6, opposite ends of web 21 and web 22 have at least one opening 40 near base end 24, when packaging cover 10 is in the mounted position. As shown in FIG. 5*a*, opening 40 comprises circular hole 41. As shown in FIG. 6, opening 40 comprises slit 42. It is apparent that slits 42 can have any other suitable shape. It is also apparent that such shapes need not be consistent between each of webs 21 and 22. Slit 42 is generally transverse with respect to longitudinal axis 45 of the single piece.

Figure 7A:
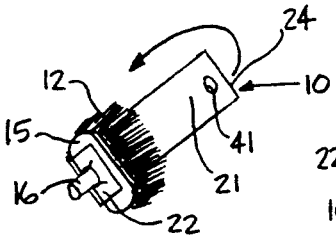
FIGS. 7*a* and 7*b* are diagrammatic views showing two steps for installing a packaging cover, according to the preferred embodiments shown in FIGS. 5*a*–6, on a brush or broom head.
Figure 7B:
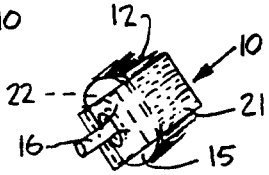
Figure 7C:
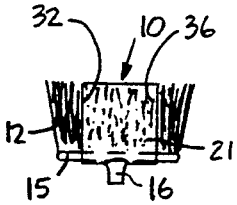
FIG. 7c shows a front view of the packaging cover as shown in FIGS. 5a–6, installed on the brush or broom head.
Figure 7D:
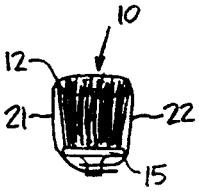
FIG. 7d shows a side view of the installed packaging cover, as shown in FIG. 7c.

FIGS. 7*a* and 7*b* are diagrammatic views showing the installation steps of packaging cover 10, according to the preferred embodiment as shown in FIGS. 5*a*–6. As shown in FIG. 7*a*, one opening 40 of either web 21 or web 22 is mated with neck portion 16. The corresponding base end 24 of cover 10 is then wrapped, in the direction of the arrow shown in FIG. 7*a*, around the free ends of bristles 12. As shown in FIG. 7*b*, such other opening 40 of either web 22 or web 21 is then mated with neck portion 16. FIGS. 7*c* and 7*d* show a diagrammatic front and side views, respectively of the installed packaging cover 10. As clearly shown in FIG. 7*c*, by having two open sides 32 and 36, a significantly reduced amount of flexible material is necessary to provide an area for advertising or instructional display since packaging cover 10 does not have to contain the entire broomhead.

Figure 8A:
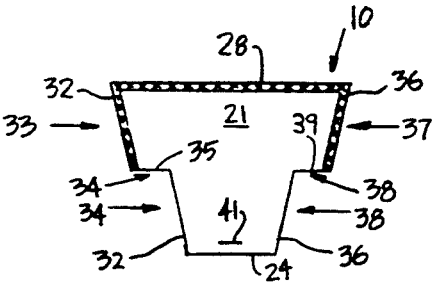
FIG. 8a shows a front view of a packaging cover according to another preferred embodiment of this invention.
Figure 8B:
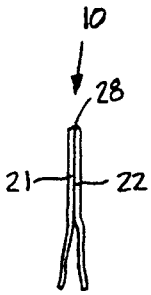
Figure 9:
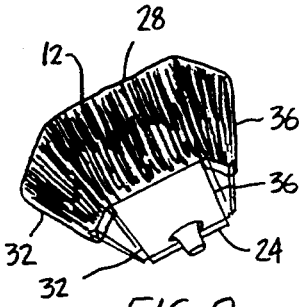
FIG. 9 shows a diagrammatic view of a packaging cover, according to the preferred embodiment shown in FIGS. 8a and 8b, installed on a broom having angled sections of bundled bristles.

FIGS. 8*a*–9 show yet another preferred embodiment of packaging cover 10, according to this invention. Such preferred packaging cover 10 can be used on a broom or other cleaning utensil having bristles formed at an angle, as shown in FIG. 9. Such preferred embodiment of packaging cover 10 comprises web 21 and web 22 each having at least one opening 40. Side 32 and side 36 are correspondingly joined along only a portion of side 32 and only along a portion of side 36, from top end 28. Such web portions can be joined with a heat seal, an adhesive or by any another suitable method.

As shown in FIG. 8*a*, side 32 and side 36 of each of web 21 and web 22 are preferably offset inwardly toward each other as they approach base end 24. FIG. 8*a* also shows the preferred heat sealed areas of such preferred embodiment of packaging cover 10.

Also as shown in FIG. 8*a*, intermediate side 35 of each web 21 and 22 is formed between joined portion 33 and separated portion 34, and intermediate side 39 is formed between joined portion 37 and separated portion 38 of side 36. Intermediate sides 35 and 39 are preferably separated between both webs to better accommodate bristles 12. In one preferred embodiment of this invention, intermediate sides 35 and 39 are generally parallel to base end 24, as shown in FIG. 8*a*.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A packaging cover for bristles of a cleaning apparatus having a base with a neck portion, wherein the bristles are attached to the base, the packaging cover comprising:

two webs of flexible sheet material, a base end, a top end opposite said base end, said webs joined at said top end;

said webs of said sheet material having a first side and a second side each extending between said base end and said top end, said first side opposite said second side, and said webs separated from each other along at least a portion of each of said first side and said second side;

each said web having said at least one opening and said first side and said second side of both said webs correspondingly joined along only a joined portion of said first side and said second side, respectively, from said top end;

said first side and said second side of each said web offset inward toward each other and separated from each other along only a separated portion of said first side and said second side from said base end;

a first intermediate side of each said web formed between said joined portion of said first side and said separated portion of said first side, and a second intermediate side of each said web formed between said joined portion of said second side and said separated portion of said second side; and said first intermediate side and said second intermediate side generally parallel to said base end.

2. A packaging cover according to claim 1 wherein said first sides and said second sides of said webs are joined along said joined portion by a heat seal.

3. A packaging cover according to claim 1 wherein said first intermediate sides of said webs are separated and said second intermediate sides of said webs are separated.

4. A packaging cover according to claim 1 wherein said flexible sheet material is a polymeric material.

5. A packaging cover according to claim 1 wherein said webs are joined at said top end by a heat seal.

6. A packaging cover according to claim 1 wherein said webs are joined at said base end by a heat seal.

7. A packaging cover according to claim 1 wherein said sheet material is folded at said top end to form said webs.

8. A packaging cover according to claim 7 wherein each of said webs has said at least one opening near said base end of each said web.

9. A packaging cover according to claim 8 wherein each said opening is a slit.

10. A packaging cover according to claim 9 wherein said single piece is elongated and each said slit is generally transverse with respect to a longitudinal axis of said single piece.

* * * * *